US009194018B2

(12) United States Patent
Resiak et al.

(10) Patent No.: US 9,194,018 B2
(45) Date of Patent: Nov. 24, 2015

(54) MICROALLOYED STEEL WITH GOOD RESISTANCE TO HYDROGEN FOR THE COLD-FORMING OF MACHINE PARTS HAVING HIGH PROPERTIES

(75) Inventors: Bernard Resiak, Saulny (FR); Mario Confente, Plappeville (FR); Renë Cathiard, Frahier (FR); Bernard Starck, Kappelen (FR)

(73) Assignee: ArcelorMittal Gandrange S.A., Gandrange (FR)

( * ) Notice: Subject to any disclaimer, the term of this patent is extended or adjusted under 35 U.S.C. 154(b) by 312 days.

(21) Appl. No.: 12/594,944

(22) PCT Filed: Apr. 9, 2008

(86) PCT No.: PCT/FR2008/000496
§ 371 (c)(1),
(2), (4) Date: Oct. 7, 2009

(87) PCT Pub. No.: WO2008/142275
PCT Pub. Date: Nov. 27, 2008

(65) Prior Publication Data

US 2010/0135745 A1 Jun. 3, 2010

(30) Foreign Application Priority Data

Apr. 12, 2007 (FR) ..... 07 02666

(51) Int. Cl.

| | |
|---|---|
| ***C21D 8/06*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |

(52) U.S. Cl.
CPC . *C21D 8/06* (2013.01); *C22C 38/04* (2013.01); *C22C 38/44* (2013.01); *C22C 38/46* (2013.01); *C22C 38/48* (2013.01)

(58) Field of Classification Search
USPC ..... 420/104–106, 108–112, 119, 121, 123, 420/124, 126, 127; 411/378
See application file for complete search history.

(56) References Cited

U.S. PATENT DOCUMENTS

| | | | |
|---|---|---|---|
| 5,073,338 | A | 12/1991 | Furusawa et al. |
| 2003/0150529 | A1 | 8/2003 | Uno et al. |

FOREIGN PATENT DOCUMENTS

| | | | | |
|---|---|---|---|---|
| CN | 1603447 | A | | 4/2005 |
| EP | 1 746 177 | A | | 1/2007 |
| GB | 2 169 313 | A | | 7/1986 |
| JP | 11270531 | A | * | 10/1999 |
| JP | 2001 032044 | A | | 2/2001 |
| JP | 2003027185 | A | * | 1/2003 |
| JP | 2000328191 | | | 11/2008 |

OTHER PUBLICATIONS

Omura et al., English machine translation of JP 2003-027185, Jan. 29, 2003, whole document.*
Yamazaki et al., English machine translation of JP 11-270531, Oct. 1999, whole document.*
Ogle et al., "Phosphate Conversion Coatings", ASM Handbook, 2003, ASM International, vol. 13A, p. 1.*
International Search Report, Nov. 21, 2008, from International Phase of the instant application.

* cited by examiner

*Primary Examiner* — Roy King
*Assistant Examiner* — Caitlin Kiechle
(74) *Attorney, Agent, or Firm* — Davidson, Davidson & Kappel, LLC

(57) ABSTRACT

The steel according to the invention is characterized in that, in order to keep its weight content of molybdenum below 0.45%, its chemical composition, besides the iron and the inevitable residual impurities that result from the smelting of the steel, corresponds to the following analysis, given as percentages by weight:

0.3≤C %≤0.5
0.20≤Mo %<0.45
0.4≤Mn %≤1.0
0.4≤Cr %≤2.0
0.04≤Ni %≤0.8
0.02≤Nb %≤0.045
0.03≤V %≤0.30
0.02≤Ti %≤0.05, with Ti>3.5 N
0.003≤B %≤0.005%
S %≤0.015
P %≤0.015, and optionally 0.05≤Si %≤0.20; Al %≤0.05 and N %≤0.015. By cold forming a hot-rolled wire rod resulting from continuous casting, it is possible to obtain, after heat treatment, "ready-to-use" coined parts, such as cap screws for example for the automotive industry, that offer a tensile strength from 1200 to more than 1500 MPa while having a good hydrogen embrittlement resistance, and this with a specially controlled "raw material" production cost.

20 Claims, No Drawings

MICROALLOYED STEEL WITH GOOD RESISTANCE TO HYDROGEN FOR THE COLD-FORMING OF MACHINE PARTS HAVING HIGH PROPERTIES

BACKGROUND OF THE INVENTION

The invention relates to microalloyed steels for the cold forming, via coining in particular, of assembly parts, such as screws, bolts, etc. that the automotive industry commonly uses for assembling ground contact or engine components of vehicles.

DESCRIPTION OF THE PRIORITY ART

As is known, the automotive industry continually aims to increase the power of engines at the same time as it seeks to reduce the weight thereof, therefore to use parts of increasingly reduced size. These parts, which remain subject to the same mechanical stresses, must therefore have increasingly high mechanical properties, in particular tensile strength.

To date, the very great majority of microalloyed steels, used for example in automotive fastenings, make it possible to obtain screws that come under class 10.9, therefore that are endowed with a tensile strength of 1000 MPa and above. This strength, which is already high, may be artificially increased further by some 100 to 200 MPa approximately by the tightening of the screws at the very moment of assembling the parts. It will be understood that such a practice cannot however be used as a solution in itself for the desired increase in the tensile strength.

The other way, namely the "natural" way, which addresses the metallurgy of their manufacture, rapidly comes up against problems of embrittlement linked to the presence of hydrogen in the steel. As is known, this is because the hydrogen in steel is the cause of delayed or even sometimes immediate fracture mechanisms, which results in the breakage of the part in service during the application of a certain stress level.

Grades of microalloyed steel for screws having very high mechanical properties (1300 MPa and above in strength) have already been proposed that aim to improve their hydrogen resistance. This is the case, for example, for the grade described in document U.S. Pat. No. 5,073,338 from December 1991 and in which molybdenum is added in an amount up to 1% by weight with a minimum of 0.5%.

However, it may be feared that the heat treatments undergone by the steel during coining lead to an accumulation, at certain locations in the metallic matrix, of bulky molybdenum carbides that will embrittle the steel structure and therefore will not always make it possible to obtain the desired mechanical properties. Another drawback may be experienced in a certain reduction in cold deformability following the increase in the hardness of the steel due to the presence of this hardening element in a large amount. Furthermore, molybdenum is a product that is particularly expensive on the market, so that introducing a large amount thereof into the steel generates a large production cost overrun.

Nevertheless, despite these drawbacks, the grades proposed in the literature for microalloyed steels intended for fastenings seem to persevere in the direction of a high presence of molybdenum in order to be able to achieve mechanical strength levels greater than 1300 MPa. This is the case, for example, for the grade described in document JPA 2001032044 published in February 2001, in which the weight content of molybdenum lies between 1.5 and 3%. It is also the case for the grade described in document EPA 1746177 published in January 2007 in which the molybdenum content may rise up to 6%, without being able to be below 0.5%.

It may be seen therefore from this rapid survey of the known prior art that it appears relatively easy in fact to achieve, via the metallurgy, microalloyed steels for parts having high mechanical strength, without thereby necessarily impairing the hydrogen resistance, but that it is much less easy to obtain such a result when a deliberately low molybdenum content is set.

SUMMARY OF THE INVENTION

In contrast to the approach followed by the prior art, the objective of the invention is to provide an economical microalloyed steel having a molybdenum content deliberately set, for this purpose, at less than 0.45% by weight, and that has good hydrogen resistance, while making it possible to achieve high mechanical properties in the final ready-to-use parts produced from this steel.

For this purpose, one subject of the invention is a microalloyed steel with good resistance to hydrogen embrittlement for the cold forming of machine parts with high properties, characterized in that, in order to keep its weight content of molybdenum below 0.45%, its chemical composition, besides the iron and the inevitable residual impurities that result from the smelting of the steel, corresponds to the following analysis, given as percentages by weight:

$0.3 \leq C\ \% \leq 0.5$
$0.20 \leq Mo\ \% < 0.45$
$0.4 \leq Mn\ \% \leq 1.0$
$0.4 \leq Cr\ \% \leq 2.0$
$0.04 \leq Ni\ \% \leq 0.8$
$0.02 \leq Nb\ \% \leq 0.045$
$0.03 \leq V\ \% \leq 0.30$
$0.02 \leq Ti\ \% \leq 0.05$, with $Ti > 3.5\ N$
$0.003 \leq B\ \% \leq 0.005\%$
$S\ \% \leq 0.015$
$P\ \% \leq 0.015$, and optionally $0.05 \leq Si\ \% \leq 0.20$; $Al\ \% \leq 0.05$ and $N\ \% \leq 0.015$.

Another subject of the invention is a long rolled steel product (wire rod or bar) made of microalloyed steel resulting from the continuous casting in the form of billets or blooms and having a chemical composition that conforms to the analysis given above in order to be capable of exhibiting, after conversion by cold forming and a quenching and tempering heat treatment, a mechanical strength of 1200 to 1500 MPa and above, combined with a good hydrogen resistance.

Yet another subject of the invention is a ready-to-use machine part, that is cold formed, by coining in particular, and that has high mechanical properties and also good hydrogen resistance, characterized in that it is made of microalloyed steel corresponding to the chemical composition given above and, preferably, produced from a long rolled steel product (bar, or more commonly, wire rod), resulting from the continuous casting in the form of billets or blooms.

Also preferably, said machine part is a cap screw for assembly in the automotive industry.

It will already have been understood that a range of 0.20 to 0.45% of Mo is sufficient in fact, in the case of the invention, to obtain synergy between this particular element and the other elements present in the chemical composition of the steel which are, on the one hand, niobium, vanadium and titanium (which all act in the precipitated state therefore in favor of grain hardening and grain refining of the structure of the steel), and on the other hand, the boron present in order to increase the hardenability of the grade and which will make it possible to obtain in fine a dominant martensite microstructure under the standard conditions of the heat treatment suitable for cold forming, by coining or another process.

It is furthermore important to note that the route followed by the invention for the smelting of such a grade having a low molybdenum content has been to create a microalloyed steel that makes it possible to withstand a higher amount of hydrogen than in the prior art. In order to do this, the grade has been optimized in order to respond to the problems linked to the hydrogen, no longer by the single conventional approach, namely that of trapping of this element, but by three different routes together. The research carried out has been able to show, in effect, that the hydrogen resistance of the steel could result from various independent factors, such as the chemical composition or the microstructure, but also, and this will be easily understood, the amount of hydrogen already present in the steel before the parts are brought into service.

The hydrogen, according to the invention, is therefore treated by the following three routes:

1—Trapping. The grade according to the invention has the feature of increasing and diversifying the hydrogen traps so as to avoid an agglomeration, at a single location, of carbides of the same type that would embrittle the structure and impair the mechanical strength of the steel. Specifically, molybdenum is no longer the favored hydrogen trap, since the grade also contains, for this purpose, niobium, titanium, chromium and vanadium.

2—Distribution. The elements, such as boron, niobium, molybdenum, vanadium and titanium are favored, as they allow the grain refinement, which makes it possible to increase the hydrogen resistance. Specifically, since increasing grain fineness leads to an increase in the surface area of the grain boundaries, the hydrogen is then better distributed in the steel and therefore becomes less harmful.

3—Elimination. The hydrogen, introduced into the steel during the preparatory phases of the material with a view to coining, may be partly removed during the final quenching and tempering heat treatment carried out on the coined parts manufactured with steel according to the invention. The increase in tempering temperature favors this degassing. This increase is made possible by the presence of hardening elements that make it possible to go in this direction, such as vanadium, titanium, molybdenum and niobium, and also boron via its synergistic effect with niobium and molybdenum. The grade according to the invention makes it possible to achieve tempering temperatures of around 400° C. or more.

Hence, in the case, for example, of the production of cap screws by cold coining, it has been possible to seek a higher mechanical strength of the screws before tightening. The "ready-to-use" parts produced with the grade of steel according to the invention indeed have, without particular difficulties, a final tensile strength of 1200 MPa, or even 1500 MPa (and even higher, depending on the temperature setting that will be imposed for the final heat treatment), while displaying beforehand an intermediate strength, of half at least, or even of a third only at the end of spheroidization annealing carried out preferably just before the coining, in order to facilitate the work of coining.

DESCRIPTION OF THE PREFERRED EMBODIMENTS

The invention will be well understood and other aspects and advantages will appear more clearly in light of the description that follows, given solely by way of exemplary embodiment of screws for the automotive industry.

Produced in the steel mill by continuous casting are long semi-finished products (billets or blooms) made from a microalloyed steel having, besides iron, and less than 0.45% of molybdenum that is set, the following chemical composition, in weight contents:

from 0.3 to 0.5% carbon.

For contents below 0.3%, the very high strength desired cannot be achieved in view of the content of the other elements present in the grade and of the high tempering temperatures targeted. For contents greater than 0.5%, the risk of embrittlement increases due to the increase in the hardness;

at least 0.20% of molybdenum, but without ever reaching or exceeding 0.45% for the reasons indicated.

Molybdenum interacts strongly with phosphorus, the damaging effect of which it thus limits by limiting its segregation at the grain boundaries. Furthermore, it displays a marked carbide-forming behavior. For given mechanical properties, it allows higher tempering temperatures, which, as a result, favor the development of carbides that will be hydrogen traps. It is therefore an element that increases the resistance to delayed fracture, from 0.4 to 1.0% manganese.

Increasing the manganese content tends, as a general rule, to reduce the delayed fracture resistance of the steel. This could originate from its interaction with sulfur that leads to the formation of manganese sulfides. When thresholds in the vicinity of 1% manganese are exceeded, this interaction with sulfur could even result in increasing the hydrogen brittleness of the steel, this being, of course, if no adequate provisions are made in order to avoid it. Manganese has however a beneficial effect on the hardenability of the steel and therefore on obtaining the desired final mechanical properties in the parts produced;

less than 0.015% phosphorus.

The effect of phosphorus is particularly harmful in the steels according to the invention, for several reasons. Via a troublesome hydrogen recombination effect, it contributes to a higher concentration of atomic hydrogen capable of penetrating into the material, therefore to an increased risk of delayed fracture of the part in use. Moreover, by segregating at the grain boundaries, it reduces the cohesion thereof. Its content must therefore imperatively be kept very low. For this purpose, measures must be taken to ensure that the steel is dephosphorized during its smelting in the liquid state;

from 0.05 to 0.2% silicon.

Silicon acts as a deoxidizer of the steel during its smelting, in the liquid state. Present in solid solution in the solidified metal, it also makes it possible to increase the strength of the steel. However, at too high a content (more than 0.2%), it may have a damaging effect. During heat treatments, such as a spheroidization treatment, silicon has a tendency to form intergranular oxides and thus reduces the cohesion of the grain boundaries. Too high a content of silicon also reduces the cold deformability of the steel by excessively hardening the matrix. It is mainly for this reason that, in the case of the grade of steel according to the invention, its maximum content has been set at 0.2%;

0.05% maximum of aluminum.

Aluminum is a deoxidizer of the steel in the liquid state. It then contributes, in the form of nitrides, to controlling austenitic grain coarsening during hot rolling. On the other hand, present in too large an amount, it may lead to a coarsening of aluminate type inclusions in the steel which may prove damaging to the properties of the metal, especially its toughness;

from 0.4 to 2.0% chromium.

Chromium is generally desired for its hardening effect. Like molybdenum, it slows down the softening during tempering, allowing higher tempering temperatures which favors degassing but also the formation of carbides that trap hydrogen. At too high a content, by excessively increasing the hardness of the steel, it makes it difficult to form it by coining;

from 0.04 to 0.8% nickel.

This element provides an increase in the strength of the metal and has beneficial effects on the resistance to brittle fracture. It also improves, in a known manner, the corrosion resistance of the steel;

from 0.02 to 0.045% niobium, from 0.03 to 0.30% vanadium, and from 0.02 to 0.05% titanium.

These three elements are often added to liquid steel in order to increase the hardness of the material. Here, within the ranges indicated, they will also increase the delayed fracture resistance in several ways. They will contribute to austenitic grain refinement and form precipitates that trap hydrogen. In addition, niobium traps phosphorus. Finally, the hardening effect of each makes it possible to carry out tempering operations at higher temperature. Their maximum content is set here in order to avoid obtaining precipitates of too large a size which would then degrade the resistance of the steel to delayed fracture.

Niobium, in particular, when it is added in too large an amount, leads to an increased risk of "crack" defects at the surface of the billets and blooms as continually cast. These defects, if they cannot be completely eliminated, may prove very damaging in respect of the integrity of the properties of the final part, especially as regards fatigue strength and hydrogen resistance. This is why, in the case of the grade according to the invention, its content has had to be kept below 0.045%;

from 0.003 to 0.005% boron.

By segregating at the former austenitic grain boundaries, boron, even at very low contents, makes it possible to increase the resistance to hydrogen-induced delayed fracture. It strongly increases the hardenability of the steel and thus makes it possible to limit the carbon content needed to obtain the desired martensitic microstructure. It increases the cohesion of the grain boundary via its intrinsic effect, but also by making phosphorus segregation more difficult at these grain boundaries. Finally, boron acts in synergy with molybdenum and niobium, thus increasing the effectiveness of these elements and their own influence that their respective contents permit. An excess of boron (above 0.005%) would however lead to the formation of brittle iron boro-carbides.

less than 0.015% sulfur.

Sulfur is, for steel, a poison that expresses all its harmfulness in the presence of hydrogen, since it has an additive, i.e. cooperative, effect with it by especially forming $H_2S$, which in a moist environment in particular leads unstoppably to rapid physical degradation of the parts. Its effect is moreover, in this regard, much more pronounced than that of phosphorus. Its content must therefore be limited as much as possible, as close to zero as possible, in any case not exceeding the limit of 0.015% decreed here. The steel must therefore be carefully desulfurized during its smelting in the liquid state in the steel mill;

less than 150 ppm nitrogen.

Nitrogen is considered to be harmful. It traps boron via the formation of boron nitrides, which makes the role of this element in the hardenability of the steel ineffective. Nevertheless, added in small amounts, it makes it possible, via the formation in particular of titanium nitrides (TiN) and aluminum nitrides (AlN), to avoid excessive austenitic grain coarsening during heat treatments undergone by the steel. Similarly, it also allows, in this case, the formation of carbonitride precipitates that will contribute toward the trapping of hydrogen.

This optimized composition makes it possible to have a very good hydrogen resistance at the same time as a final mechanical strength of the steel, once converted to a ready-to-use coined part after final heat treatment, which is greater than 1200 MPa and which may even exceed 1500 MPa, while keeping the standard manner of carrying out this conversion the same.

After reheating above 1100° C. if necessary, the semi-finished steel product (bloom, or more generally, billet) is then hot rolled in the austenitic region, according to standard practice, until a long rolled product is obtained that is ready to be sent out to the customer after cooling to room temperature. This long steel product is then in the form of bars, or more generally in the form of coiled wire rod for the intended applications.

The wire rod is then converted to screws by cold coining, schematically in the following conventional manner:

The converter receives the wire and after mechanical descaling (or pickling optionally followed by neutralization), he carries out an annealing in a neutral atmosphere (under nitrogen for example) on the wire. The wire is then degreased before undergoing a first wire-drawing operation, known as rough wire-drawing, for which a prior surface coating is provided, conventionally a phosphate treatment and soaping. During this wire-drawing operation, the diameter of the wire is reduced by around 30%.

The rough-drawn wire obtained is then subjected to a spheroidization treatment which, by procuring a temporary drop in its hardness (intermediate $R_m$ at around 500 MPa), will make it possible to facilitate its subsequent forming, during the coining operation, by protecting the tool. This first heat treatment is followed by pickling, phosphate treatment and soaping with a view to a second drawing operation. This is a finishing drawing operation, also known as a "final sizing" drawing operation. The reduction in diameter is more modest than before, generally less than 10%.

The wire, provided with a temporarily weakened strength of around 500 MPa, is then easily cold coined. The as-coined screws are firstly dephosphatized, then subjected to a final quenching and tempering heat treatment, and also to a final rolling operation in order to give the thread its final appearance. The rolling may be carried out either before the heat treatment, or after. The tempering may advantageously take place at higher temperatures than standard practice, namely at around 400° C. and above, without however impeding the achievement of the final tensile strength expected for the ready-to-use screws produced, i.e. with an $R_m$ of 1200 to 1500 MPa and above. Of course, the higher the temperature that the tempering is carried out at, the lower the final $R_m$ will be.

The surface of the screws is then cleaned and coated with a layer of phosphates or, where appropriate, by any other suitable chemical or electrochemical coating.

It will be noted that if the grade of steel has been specially smelted in order to offer a good hydrogen resistance, it is of course also desirable to introduce as little hydrogen as possible during the conversion process of the wire rod. However, these processes for conversion into coined and coated parts are customarily, by nature, hydrogen-intake generators. For example, during pickling, the bath parameters (temperature, nature and concentration of acid, iron pollution, inhibitor content, etc.) have an effect on the introduction of hydrogen into the steel. Similarly, since the phosphating treatment is a hydrogen generator, it will be advisable to optimize the parameters of the treatment in order to limit as much as possible the uptake of hydrogen by the metal at this stage of the conversion. The knowledge of a person skilled in the art will also play an important role during the austenitizing step before quenching. Specifically, it has been shown that this step of the forming process may lead, when adequate precautions are not taken, to a not inconsiderable penetration of hydrogen into the steel.

Some numbers are now given, using the tables of values below, which relate to the microalloyed steel grade according to the invention by positioning this grade relative to known grades.

Laboratory tests were carried out on castings having the following chemical compositions (in weight percentages):

| | C | Mn | P | S | Si | Ni | Cr | Mo | Nb | V | Ti | B |
|---|---|---|---|---|---|---|---|---|---|---|---|---|
| A | 0.36 | 0.48 | 0.006 | 0.008 | 0.07 | 0.35 | 1.17 | 0.55 | 0.035 | 0.13 | 0.02 | 0.0025 |
| B | 0.37 | 0.79 | 0.014 | 0.01 | 0.08 | 0.25 | 1.20 | 0.31 | 0.033 | 0.11 | 0.02 | 0.0026 |
| C | 0.36 | 0.64 | 0.013 | 0.01 | 0.08 | 0.39 | 1.11 | 0.45 | 0.037 | 0.11 | 0.02 | 0.0025 |
| D | 0.38 | 0.79 | 0.006 | 0.007 | 0.07 | 0.39 | 1.16 | 0.20 | 0.035 | 0.14 | 0.02 | 0.0024 |
| 42CD4 | 0.41 | 0.87 | 0.011 | 0.005 | 0.22 | 0.08 | 1.04 | 0.15 | — | — | — | — |

with, each time, Al≤0.05% and N≤0.015%.

It will also be noted that, depending on its manufacturing process, and especially when it is smelted from scrap iron, the steel may contain up to 0.15% copper.

The castings A and 42CD4 are grades of steel known in the prior art. The castings B, C and D are examples of the grade of steel according to the invention.

The known grade A has, in particular, a molybdenum content of greater than 0.5% and the known grade 42CD4 does not contain niobium, or vanadium or titanium or boron.

The mechanical properties of the final parts obtained are the following, where Δ (Z) expresses the necking:

| | $T_t$ (° C.) | $R_m$ (MPa) | Δ (Z) in % |
|---|---|---|---|
| A | >400 | 1538 | <5 |
| B | >400 | 1532 | <5 |
| C | >400 | 1545 | <5 |
| D | >400 | 1535 | <5 |
| 42CD4 | >400 | 1505 | 16.5 |

The second column, $T_t$, indicates the tempering temperature after quenching of the final parts. The third column, $R_m$, gives the tensile strength determined by tensile tests on standardized test specimens.

As regards the resistance to delayed fracture (last column), these results were obtained by slow tensile tests (0.005 to 0.01 mm/min versus 5 mm/min customarily) on standardized test specimens loaded and not loaded with hydrogen. The hydrogen loading conditions are identical for all the five grades tested. The amount of hydrogen introduced into the test specimens is greater than that introduced by the coining operation. The resistance to delayed fracture is expressed by Δ (Z), namely the average Z of the non-loaded test specimens minus the average Z of the loaded test specimens, Z being a measure of the necking of the test specimen during its fracture in the course of its elongation. In other words, the higher the necking reduction when the steel is loaded with hydrogen (and therefore the higher Δ (Z)), the less resistant the steel is to delayed fracture.

As can be observed, the grades of the invention B, C and D make it possible to obtain hydrogen resistance and mechanical strength results equivalent to the known grade A that contains more than 0.5% molybdenum. The known grade 42CD4, which also contains little molybdenum, but does not contain niobium, vanadium, boron or titanium, gives good results from the point of view of the mechanical strength, but does not offer a satisfactory hydrogen resistance.

The presence of elements such as titanium, boron, vanadium and niobium under the conditions defined by the invention is therefore essential for obtaining grades having high mechanical properties and exhibiting an improved resistance to delayed fracture for grades of steel having a low molybdenum content.

The microalloyed steel according to the invention is therefore remarkable in that it has both good cold mechanical deformability (coining or forging) and good hydrogen resistance (resistance to delayed fracture) and in that it makes it possible to obtain, after a quenching and tempering heat treatment, ready-to-use machine parts that have a very high tensile strength.

Specifically, it makes it possible to temporarily maintain a low strength (for example of less than 550 MPa) and a high ductility in the wire rod that undergoes cold coining, and then, after its conversion to ready-to-use parts, to bring, via a conventional quenching/tempering heat treatment, this same mechanical strength to levels that are three times higher (1500 MPa and above) and to retain a good ductility.

Therefore, the grade of steel of the invention constitutes a raw material of choice for the industrial production of assembly parts having the required high mechanical properties, such as screws for the automotive industry, when it is conditioned as wire rod or, more generally, as a hot-rolled long steel product resulting from the continuous casting in the form of billets or blooms.

It goes without saying that the invention shall not be limited to the examples that have just been described, but extends to multiple variants and equivalents as long as its definition given in the appended claims is respected.

Thus, although it was initially conceived to respond to a specific need expressed by the automotive industry confronted with questions of resistance over time of the vital components of moving vehicles, it nonetheless has a more general application in the production of any machine parts of small and medium size, such as rivets, clips, staples, various fastenings, etc., so long as a high normalized tensile strength ($R_m$ of 1200 MPa and above) combined with a good hydrogen embrittlement resistance is desired.

What is claimed is:

1. A microalloyed steel with resistance to hydrogen embrittlement for the cold forming of machine parts, comprising a chemical composition, besides the iron and the inevitable residual impurities that result from the smelting of the steel, given as percentages by weight:

0.3≤C %≤0.5

0.20≤Mo %≤0.45

0.4≤Mn %≤1.0

1.11≤Cr %≤2.0

0.04≤Ni %≤0.8

0.02≤Nb %≤0.045

0.03≤V %≤0.30
0.02≤Ti %≤0.05, with Ti>3.5 N
0.003≤B %≤0.005%
S %≤0.015
P %≤0.015.

2. The steel as claimed in claim 1, wherein it is in the form of a bar or wire rod that is hot-rolled and results from continuous casting in the form of blooms or billets.

3. A steel wire rod or bar made of microalloyed steel as claimed in claim 1 in order to be capable of exhibiting, via conversion by cold forming and a quenching and tempering heat treatment, a mechanical strength of at least 1200 MPa and above combined with resistance to delayed fracture.

4. A ready-to-use machine part resulting via cold forming, from the wire rod as claimed in claim 3.

5. The steel as recited in claim 1 wherein a resistance to delayed fracture is less than 5%.

6. A ready-to-use machine part made of the steel as recited in claim 1 wherein a mechanical strength is 1200 MPa or greater.

7. The ready-to-use machine part made of the steel as recited in claim 6 wherein the mechanical strength is 1500 MPa or greater.

8. The steel as recited in claim 1 further comprising copper up to 0.15% by weight.

9. The steel as recited in claim 1 further comprising aluminum up to a maximum of 0.05% by weight.

10. A screw comprising the steel as recited in claim 1 and a coating with a layer of phosphates.

11. A ready-to-use machine part, that is cold formed and that has hydrogen resistance, comprising a microalloyed steel having a chemical composition, besides the iron and the inevitable residual impurities that result from the smelting of the steel, given as percentages by weight:

0.3≤C %≤0.5
0.20≤Mo %≤0.45
0.4≤Mn %≤1.0
1.11≤Cr %≤2.0
0.04≤Ni %≤0.8
0.02≤Nb %≤0.045
0.03≤V %≤0.30
0.02≤Ti %≤0.05, with Ti>3.5 N
0.003≤B %≤0.005%
S %≤0.015
P %≤0.015.

12. The machine part as claimed in claim 11 wherein it is a cap screw.

13. The screw as claimed in claim 12 wherein it is a constituent of the assemblies of ground contact or engine components of vehicles produced by the automotive industry.

14. A microalloyed steel with resistance to hydrogen embrittlement for the cold forming of machine parts, comprising a chemical composition, besides the iron and the inevitable residual impurities that result from the smelting of the steel, given as percentages by weight:

0.3≤C %≤0.5
0.20≤Mo %≤0.45
0.4≤Mn %≤1.0
1.11≤Cr %≤2.0
0.04≤Ni %≤0.8
0.02≤Nb %≤0.045
0.03≤V %≤0.30
0.02≤Ti %≤0.05, with Ti>3.5 N
0.003≤B %≤0.005%
S %≤0.015
P %≤0.015, the steel containing carbonitrides.

15. The steel as recited in claim 14 further comprising chromium carbides.

16. The steel as recited in claim 14 further comprising titanium nitrides and aluminum nitrides.

17. The steel as recited in claim 14 wherein N is less than 150 ppm by weight.

18. The steel as recited in claim 14 further comprising molybdenum carbides.

19. A microalloyed steel with resistance to hydrogen embrittlement for the cold forming of machine parts, comprising a chemical composition, besides the iron and the inevitable residual impurities that result from the smelting of the steel, given as percentages by weight:

0.3≤C %≤0.5
0.20≤Mo %≤0.45
0.4≤Mn %≤1.0
1.11≤Cr %≤2.0
0.04≤Ni %≤0.8
0.02≤Nb %≤0.045
0.03≤V %≤0.30
0.02≤Ti %≤0.05, with Ti>3.5 N
0.003≤B %≤0.005%
S %≤0.015
P %≤0.015, the steel containing chromium carbides.

20. The steel as recited in claim 19 further comprising molybdenum carbides.

* * * * *